US008721212B2

(12) United States Patent
Chou

(10) Patent No.: US 8,721,212 B2
(45) Date of Patent: May 13, 2014

(54) COSMETIC PEN

(76) Inventor: Yu-Hsing Chou, Tainan (TW)

( * ) Notice: Subject to any disclaimer, the term of this patent is extended or adjusted under 35 U.S.C. 154(b) by 570 days.

(21) Appl. No.: 13/158,517

(22) Filed: Jun. 13, 2011

(65) Prior Publication Data

US 2012/0315078 A1 Dec. 13, 2012

(51) Int. Cl.

| | |
|---|---|
| ***B43K 8/06*** | (2006.01) |
| ***B43K 8/02*** | (2006.01) |
| ***B43K 1/12*** | (2006.01) |

(52) U.S. Cl.

CPC . *B43K 8/06* (2013.01); *B43K 8/022* (2013.01); *B43K 1/12* (2013.01)

USPC ..... 401/276; 401/205

(58) Field of Classification Search

CPC ..... B43K 1/12; B43K 8/02; B43K 8/022; B43K 8/024; B43K 8/04; B43K 8/06

USPC ..... 401/205, 276

See application file for complete search history.

(56) References Cited

U.S. PATENT DOCUMENTS

| | | | | |
|---|---|---|---|---|
| 4,749,618 | A * | 6/1988 | Kawaguchi et al. | 428/375 |
| 6,752,297 | B1 * | 6/2004 | Ische | 222/464.7 |
| 7,073,967 | B2 * | 7/2006 | Choi et al. | 401/199 |
| 2013/0004231 | A1 * | 1/2013 | Nakatani et al. | 401/198 |

FOREIGN PATENT DOCUMENTS

FR 2612089 A1 9/1988

* cited by examiner

*Primary Examiner* — David Walczak
*Assistant Examiner* — Joshua Wiljanen
(74) *Attorney, Agent, or Firm* — Alan Kamrath; Kamrath IP Lawfirm, P.A.

(57) ABSTRACT

A cosmetic pen includes a pen tube, a liquid storage core received in the pen tube, and an applicator disposed to a front portion of the pen tube. The applicator includes a metal sleeve connected to the liquid storage core and a brush received in the sleeve. The brush includes a front end projecting out of a lower end of the sleeve and a rear end positioned on an upper end of the sleeve. The sleeve includes an air slot having front and rear sections. The rear section of the air slot of the sleeve is disposed inside the liquid storage core so that the cosmetic liquid stored inside the liquid storage core can be penetrated through the air slot into the brush. The front section of the air slot of the sleeve is located outside the liquid storage core for introducing air.

3 Claims, 5 Drawing Sheets

COSMETIC PEN

BACKGROUND OF THE INVENTION

1. Field of the Invention

The present invention relates to a cosmetic pen and, more particularly, to a cosmetic pen with an applicator which can let the cosmetic liquid stored inside the cosmetic pen to flow out smoothly and to be smeared evenly.

2. Description of the Related Art

FIG. 1 shows a conventional cosmetic pen 10 including a pen tube 12, a liquid storage core 14 received in the pen tube 12, an applicator 16 disposed inside the pen tube 12 and engaged to a front end of the liquid storage core 14, a front cylinder 18 connected to a front end of the pen tube 12, and a cover 20 mounted on a rear end of pen tube 12. The liquid storage core 14 contains cosmetic liquid such as cosmetic water, essential oil, lip gloss, etc. The applicator 16 includes a brush 22 made of fibers and two plastic layers 24 and 26 enclosing the brush 22. The brush 22 includes a tip 28 on a front end thereof. A rear end of the applicator 16 is in contact with the liquid storage core 14 so that the cosmetic liquid stored inside the liquid storage core 14 can be delivered to the tip 28 of the brush 22 by means of capillarity. As a result, the usage for smearing can be achieved. However, the manufacture of the applicator 16 of the conventional cosmetic pen 10 is inconvenient and costly. More specifically, cosmetic liquid contains powder in particle form which is the cause for clogging during the delivery and flowage of the cosmetic liquid through the brush 22. Consequently, for the cosmetic liquid to flow out smoothly from the applicator 16, the brush 22 of the applicator 16 needs to be enclosed with the plastic layers 24 and 26 which are two respective manufacturing procedures. Furthermore, the two plastic layers 24 and 26 need to be processed with cutting to form air slots, and the front end of the brush 22 needs processing to form the tip 28. The processing procedures are troublesome.

BRIEF SUMMARY OF THE INVENTION

Thus, it is an objective of the present invention to overcome the aforementioned shortcoming and deficiency of the prior art by providing a cosmetic pen with an applicator specially designed for the smooth flow out of cosmetic liquid while allowing easy assembly and manufacturing of the applicator of the cosmetic pen.

To achieve the foregoing objective, a cosmetic pen of the present invention includes a pen tube, a liquid storage core received in the pen tube, and an applicator. The pen tube includes front and rear portion spaced in an axial direction. A front cylinder is mounted to the front portion of the pen tube and includes a through-hole and a ventilation slot in communication with the through-hole. The liquid storage core is received inside the pen tube and contains cosmetic liquid. The applicator is received in the front portion of the pen tube and extends through the through-hole of the front cylinder. The applicator includes a brush and a sleeve. The brush includes front and rear ends spaced in the axial direction. The sleeve includes upper and lower ends spaced in the axial direction and a receiving hole extending from the upper end through the lower end of the sleeve and receiving the brush. The front end of the brush projects out of the lower end of the sleeve, and the upper end of the sleeve is engaged in the liquid storage core. The sleeve further includes an air slot in communication with the receiving hole of the sleeve. The air slot includes front and rear sections spaced in the axial direction. The rear section of the air slot of the sleeve is disposed inside the liquid storage core, and the front section of the air slot of the sleeve is located outside the liquid storage core and in communication with the ventilation slot of the front cylinder.

In a preferred form, the brush is made of a bundle of fibers, and the sleeve is made of metal. A diameter of the rear end of the brush is larger than a diameter of the receiving hole of the sleeve so that the rear end of the brush is positioned on the upper end of the sleeve. A cover portion extends upward from the upper end of the sleeve and is bent downward to cover the rear end of the brush.

Preferably, the air slot extends in the axial direction and has an axial length of 15%-35% of an overall length of the sleeve in the axial direction.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

DETAILED DESCRIPTION OF THE INVENTION

Figure 1:
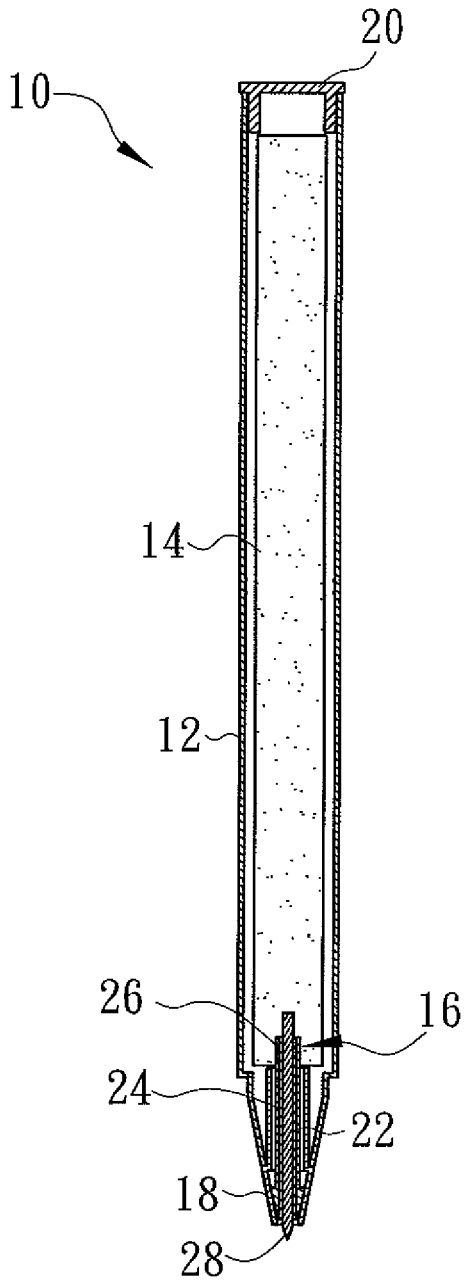
FIG.1 Prior Art
FIG. 1 shows a cross-sectional view of a conventional cosmetic pen.
Figure 2:
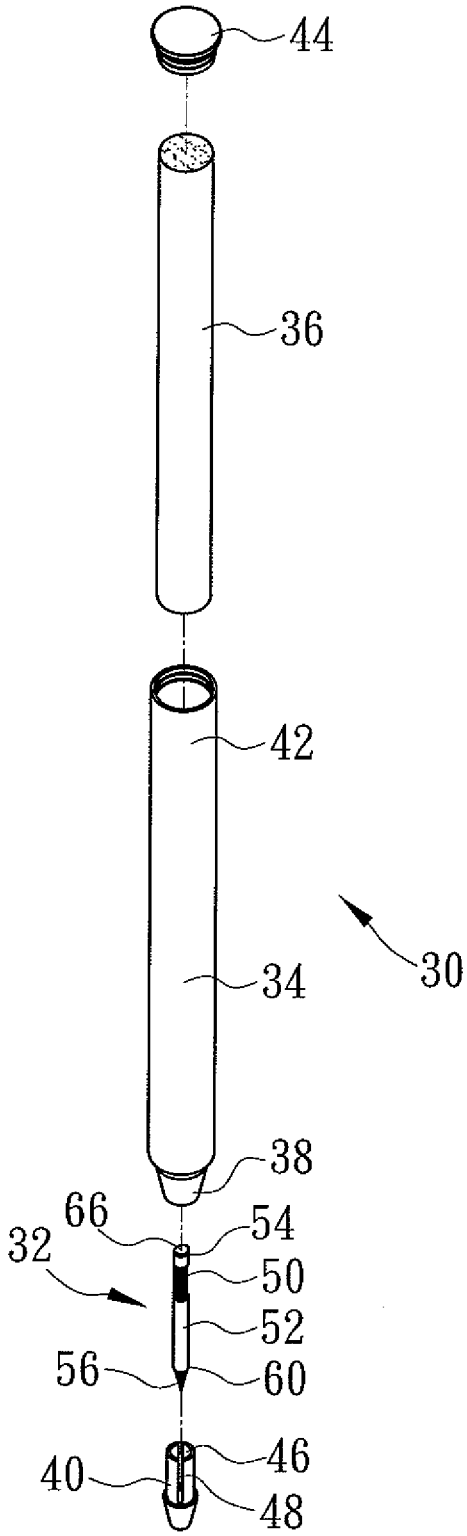
FIG. 2 shows an exploded, perspective view of a cosmetic pen according to the preferred teachings of the present invention.
Figure 3:
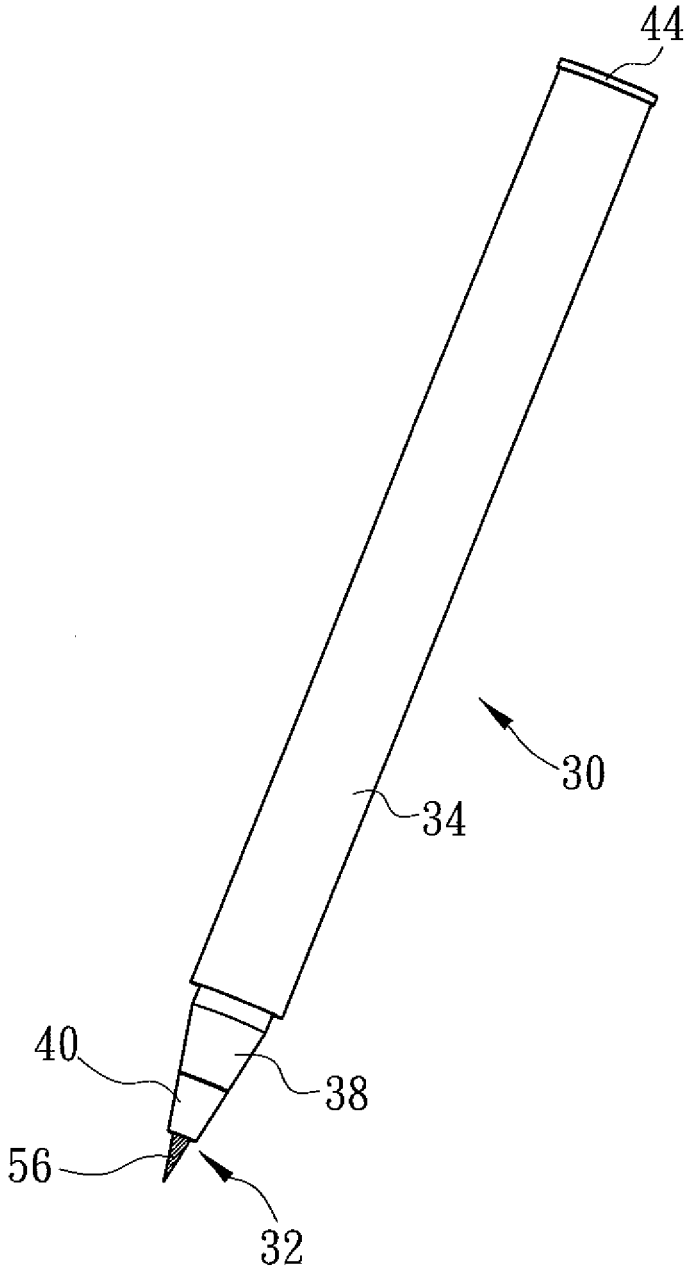
FIG. 3 shows a side plan view of the cosmetic pen of FIG. 2.
Figure 4:
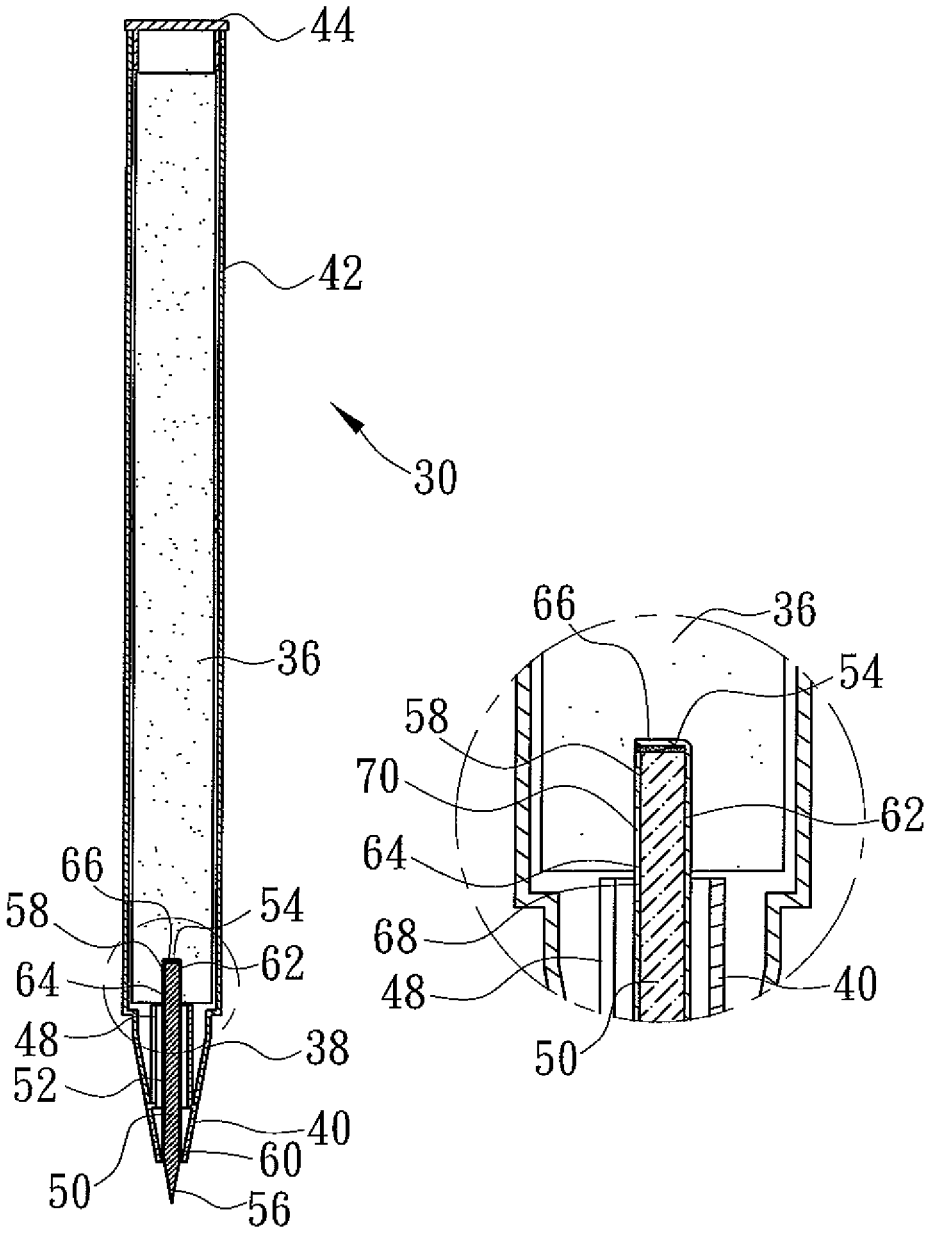
FIG. 4 shows a cross-sectional view of the cosmetic pen of FIG. 3 and an enlarged view of a circled portion of the cosmetic pen of FIG. 4.

A cosmetic pen according to the preferred teachings of the present invention is shown in FIGS. 2 through 4 of the drawings and generally designated 30. The cosmetic pen 30 includes a pen tube 34, a liquid storage core 36 received inside the pen tube 34, a front cylinder 40 connected to a front portion 38 of the pen tube 34, a cover 44 mounted on a rear portion 42 of the pen tube 34, and an applicator 32. The pen tube 34 is in the form of a hollow tube body. The liquid storage core 36 contains cosmetic liquid such as cosmetic water, essential oil, lip gloss, etc. The front cylinder 40 includes a through-hole 46 extending in an axial direction of the pen tube 34 and a ventilation slot 48 in communication with the through-hole 46. The applicator 32 is received in the front portion 38 of the pen tube 34 and extends through the through-hole 46 of the front cylinder 40.

The present invention relates more particularly to the structure of the applicator 32. The applicator 32 includes a brush 50 made of a bundle of fibers, and a sleeve 52 made of metal. The fibers for the brush 50 can be of such as cotton, linen, silk, etc., and long and fine woolen fibers would be preferable. The brush 50 includes front and rear ends 56 and 54 spaced in the axial direction. The rear end 54 of the brush 50 is connected together and has an enlarged diameter, while the front end 56 of the brush 50 is formed in a tip shape. The sleeve 52 includes upper and lower ends 58 and 60 spaced in the axial direction and a receiving hole 62 extending from the upper end 58 through the lower end 60 of the sleeve 52. The sleeve 52 further includes an air slot 64 in communication with the receiving hole 62 and extending in the axial direction. The air slot 64 includes front and rear sections 68 and 70 spaced in the axial direction (FIG. 4).

Figure 5:
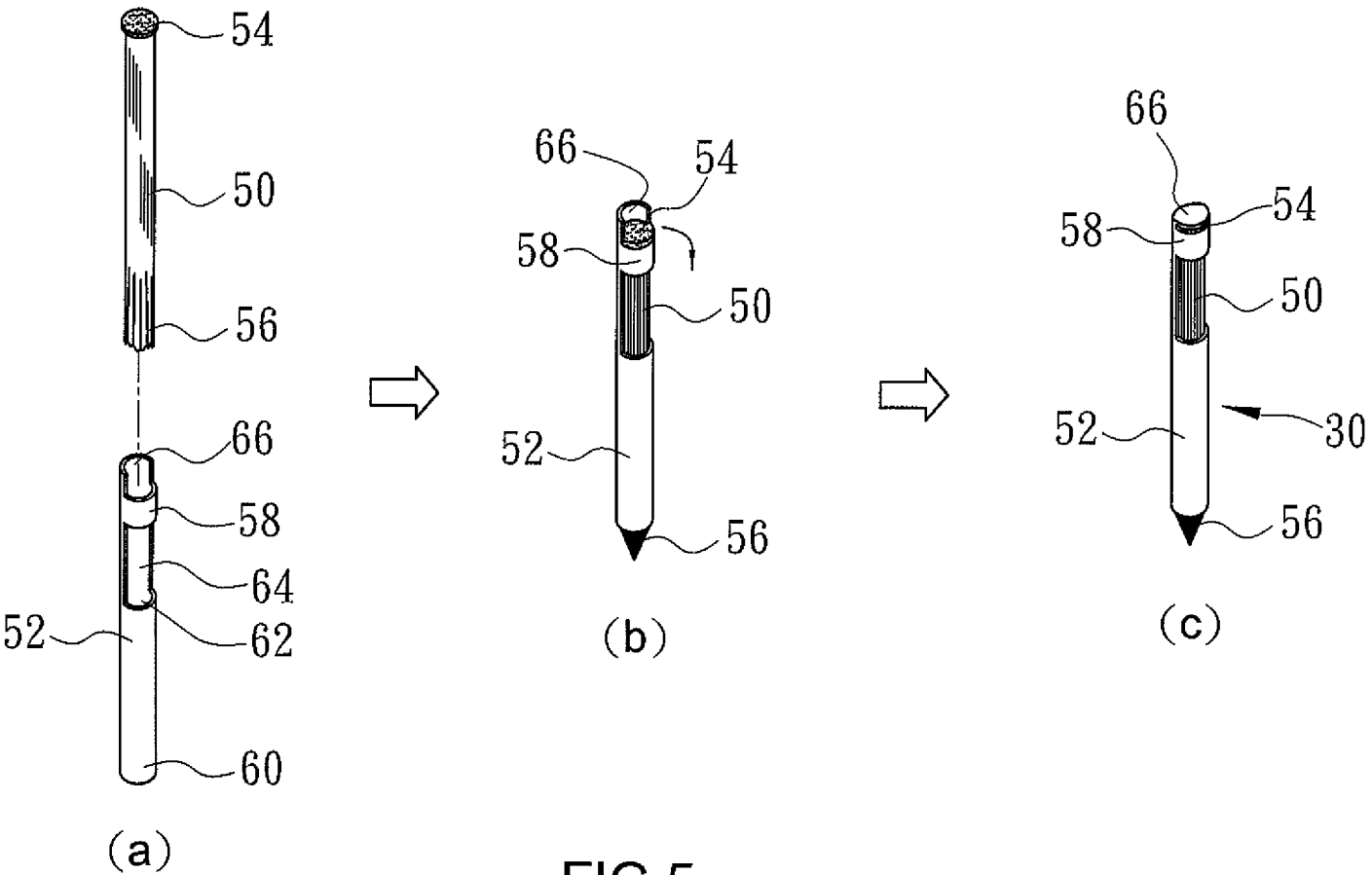
FIG. 5 shows three schematic views illustrating the assembly of an applicator of the cosmetic pen of FIG. 2.

Referring to FIGS. 5(*a*) and 5(*b*), the brush 50 is inserted inside the receiving hole 62 from the upper end 58 of the sleeve 52. The diameter of the rear end 54 of the brush 50 is a bit larger than a hole diameter of the receiving hole 62 such that the rear end 54 is positioned on the upper end 58 of the sleeve 52 after the brush 50 is inserted in the sleeve 52. Further, a circle shaped cover portion 66 extends upward from the upper end 58 of the sleeve 52 and is bent downward to cover the rear end 54 of the brush 50 after brush 50 is received in the receiving hole 62 of the sleeve 52, as shown in FIG. 5(*c*). Consequently, the brush 50 is positioned in place and can not be moved upward relative to the brush 50. Furthermore, the cover portion 66 in FIG. 5(*a*) provides a guide for the brush 50 to abut against so that the brush 50 can be smoothly inserted into the receiving hole 62 of the sleeve 52. Moreover, the sleeve 52 can be pressed inward to clamp the brush 50 more tightly after the brush 50 is received in the sleeve 52.

Referring to FIG. 4, the upper end 58 of the sleeve 52 of the applicator 32 is engaged in the front end of the liquid storage core 36 with the rear section 70 of the air slot 64 of the sleeve 52 disposed inside the liquid storage core 36 and with the front section 68 of the air slot 64 of the sleeve 52 located outside the liquid storage core 36. As the rear section 70 of the air slot 64 is disposed inside the liquid storage core 36, the cosmetic liquid stored inside the liquid storage core 36 can be penetrated through the air slot 64 into the brush 50 and can be further delivered to the front end 56 of the brush 50 by means of capillarity for smearing. On the other hand, the front section 68 of the air slot 64 is located outside the liquid storage core 36 and is in communication with the ventilation slot 48 of the front cylinder 40 for introducing air, allowing the cosmetic liquid soaked in the brush 50 to flow out smoothly and to be smeared evenly.

Preferably, the air slot 64 extends in the axial direction and has an axial length of 15%-35% of an overall length of the sleeve 52 in the axial direction. It may not be smooth for the cosmetic liquid to flow out from the applicator 32 if the axial length ratio of the air slot 64 to the sleeve 52 is less than 15%. The amount of cosmetic liquid soaked in the brush 50 may be too much if the axial length ratio of the air slot 64 to the sleeve 52 is more than 35%.

The cosmetic pen 30 of present invention includes a specially designed applicator 32 so that the cosmetic liquid soaked in the brush 50 can be delivered and flowed smoothly without clogging. Moreover, the assembly of the brush 50 and the sleeve 52 of the applicator 32 is convenient; therefore, the cosmetic pen 30 is easy to manufacture, and the cost for manufacturing, assembling, and labor are cut. Further, the powder of the cosmetic liquid does not adhere on the metal sleeve 52, thus, the nature of the cosmetic liquid flowed out from the applicator 32 will not become thin or be diluted after a certain period of usage of the cosmetic pen 30.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A cosmetic pen comprising:

a pen tube including front and rear portions spaced in an axial direction;

a liquid storage core received inside the pen tube and containing cosmetic liquid;

a front cylinder mounted to the front portion of the pen tube and including a through-hole and a ventilation slot in communication with the through-hole; and an applicator received in the front portion of the pen tube and extending through the through-hole of the front cylinder, with the applicator including a brush and a sleeve, with the brush including front and rear ends spaced in the axial direction, with the sleeve including upper and lower ends spaced in the axial direction and a receiving hole extending from the upper end through the lower end of the sleeve and receiving the brush, with the front end of the brush projecting out of the lower end of the sleeve, with the upper end of the sleeve engaged in the liquid storage core, with the sleeve further including an air slot in communication with the receiving hole of the sleeve, with the air slot including front and rear sections spaced in the axial direction, with the rear section of the air slot of the sleeve disposed in the liquid storage core, and with the front section of the air slot of the sleeve located outside the liquid storage core and being in communication with the ventilation slot of the front cylinder.

2. The cosmetic pen according to claim 1, with the brush made of a bundle of fibers, with a diameter of the rear end of the brush being larger than a diameter of the receiving hole of the sleeve so that the rear end of the brush is positioned on the upper end of the sleeve, with the sleeve made of metal, and with a cover portion extending upward from the upper end of the sleeve and being bent downward to cover the rear end of the brush.

3. The cosmetic pen according to claim 2, with the air slot of the sleeve extending in the axial direction and having an axial length of 15%-35% of an overall length of the sleeve in the axial direction.

* * * * *